US010466616B2

(12) United States Patent
Harada et al.

(10) Patent No.: US 10,466,616 B2
(45) Date of Patent: Nov. 5, 2019

(54) DEVELOPING CARTRIDGE

(71) Applicant: CANON KABUSHIKI KAISHA, Tokyo (JP)

(72) Inventors: Tatsuro Harada, Mishima (JP); Osamu Anan, Susono (JP); Teruhiko Sasaki, Mishima (JP); Ryoji Kusudo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/115,402

(22) Filed: Aug. 28, 2018

(65) Prior Publication Data

US 2019/0064697 A1 Feb. 28, 2019

(30) Foreign Application Priority Data

Aug. 31, 2017 (JP) ..... 2017-167765
Feb. 14, 2018 (JP) ..... 2018-024402

(51) Int. Cl.
*G03G 15/02* (2006.01)
*G03G 15/08* (2006.01)

(52) U.S. Cl.
CPC ..... *G03G 15/0812* (2013.01); *G03G 15/0225* (2013.01); *G03G 15/087* (2013.01); *G03G 15/0808* (2013.01); *G03G 15/0898* (2013.01); *G03G 2215/0877* (2013.01); *G03G 2221/1648* (2013.01)

(58) Field of Classification Search
CPC ..... G03G 15/0812; G03G 15/0225; G03G 15/0808; G03G 15/087; G03G 15/0898; G03G 2215/0877; G03G 2221/1648
See application file for complete search history.

(56) References Cited

U.S. PATENT DOCUMENTS 9,541,857 B2 * 1/2017 Adachi ..... G03G 21/0064
2005/0111888 A1 * 5/2005 Kim ..... G03G 15/0812 399/284
2006/0216072 A1 * 9/2006 Leemhuis ..... G03G 15/0812 399/284

(Continued)

FOREIGN PATENT DOCUMENTS

JP 05-053434 A 3/1993
JP 2008-209914 A 9/2008

(Continued)

*Primary Examiner* — Ryan D Walsh

(74) *Attorney, Agent, or Firm* — Canon U.S.A., Inc. I.P. Division

(57) ABSTRACT

A cartridge attachable to a main body of an image forming apparatus, the cartridge including a developer bearing member, a frame supporting the developer bearing member, a developing blade including a regulating member and a support member, and a collecting member. The collecting member includes a containing portion. The collecting member includes an opening opposing the developer bearing member. The containing portion extends in a rotational axis direction of the developer bearing member, and a sectional area of a longitudinal end portion area of the containing portion, orthogonal to the rotational axis direction, corresponding to a longitudinal end portion of the developer bearing member is larger than that of a longitudinal middle portion area of the containing portion.

25 Claims, 15 Drawing Sheets

(56) References Cited

U.S. PATENT DOCUMENTS

| | | | | |
|---|---|---|---|---|
| 2007/0248376 | A1* | 10/2007 | Mori et al. | G03G 15/0812 399/103 |
| 2010/0243144 | A1* | 9/2010 | Goto | G03G 15/0812 156/245 |
| 2012/0039638 | A1* | 2/2012 | Park | G03G 15/0812 399/274 |
| 2013/0051840 | A1* | 2/2013 | Yamamoto | G03G 15/0817 399/102 |
| 2015/0043950 | A1* | 2/2015 | Yasumoto | G03G 15/0812 399/284 |
| 2018/0284648 | A1* | 10/2018 | Fukatsu | G03G 15/0812 |

FOREIGN PATENT DOCUMENTS

| | | | |
|---|---|---|---|
| JP | 2009-122529 | A | 6/2009 |
| JP | 2010-8993 | A | 1/2010 |

* cited by examiner

DEVELOPING CARTRIDGE

BACKGROUND OF THE INVENTION

Field of the Invention

The present disclosure relates to a developing cartridge used in an electrophotographic image forming apparatus. In particular, the present disclosure is suitable for being used in a color electrophotographic image forming apparatus.

Herein, an electrophotographic image forming apparatus is an image forming apparatus that forms an image on a recording medium through an electrophotographic image forming process. Furthermore, examples of the electrophotographic image forming apparatus include an electrophotographic copying machine, an electrophotographic printer (for example, a laser printer, an LED printer, and the like), a facsimile machine, and a word processor.

Furthermore, the developing apparatus is a developing member that develops a latent image on an electrophotographic photosensitive drum, a developing frame that supports the developing member, and components related to the developing member integrally formed so as to be detachably attachable to a main body of an image forming apparatus.

Description of the Related Art

In image forming apparatuses, such as a printer, that uses an electrophotographic image forming process (an electrophotographic process), an electrophotographic photoconductor (hereinafter, referred to as a photosensitive drum) serving as an image bearing member is uniformly charged. Subsequently, an electrostatic image is formed on the photosensitive drum by selectively exposing the charged photosensitive drum. Subsequently, the electrostatic image formed on the photosensitive drum is visualized as a toner image with toner serving as the developer. Subsequently, the toner image formed on the photosensitive drum is transferred on a recording material such as a recording sheet or a plastic sheet and, further, heat and pressure is applied to the toner image transferred on the recording material so as to fix the toner image on the recording material and to perform image recording.

Typically, such an image forming apparatus needs to have maintenance performed on the various process members. In order to facilitate maintenance of the various members, a process cartridge that is detachably attachable to an image forming apparatus main body (hereinafter, referred to as an apparatus main body) is in practical use in which, a photosensitive drum, a charging member, a developing member, a cleaning member, and the like are fainted into a cartridge inside a frame. The process cartridge system can provide an image forming apparatus with high usability.

A configuration of such a process cartridge including a cleaning unit having a photosensitive drum, a developing unit having a developing member, and a toner unit that supplies developer is known.

In a configuration in which such a unit or a process cartridge is attached to and detached from the apparatus main body, a method in which the unit or the process cartridge is attached to and detached from the apparatus main body in an axial direction of the photosensitive drum has been proposed (see Japanese Patent Laid-Open No. 2010-8993). The process cartridge that has been inserted in the apparatus main body moves vertically upwards, and the position of the process cartridge with respect to the apparatus main body is set by having the restricted portion provided in the process cartridge come in contact with a restricting portion provided in the apparatus main body.

The developing unit of the process cartridge includes a developer bearing member that feeds developer to the photosensitive drum, a developing chamber in which a developer feed member that feeds developer to the developer bearing member is provided, and a developer containing chamber that contains the developer fed to the developing chamber. Furthermore, a configuration has been proposed in which the developer bearing member is disposed vertically above the developing unit, and the developer containing chamber provided with the developer bearing member is positioned vertically bellow the developing chamber.

Meanwhile, in order to prevent the scattering toner falling onto the developing blade from leaking in the image forming apparatus, a configuration has been proposed in which, in the developing unit, a sheet member in which the first end thereof is fixed and the second end thereof is in sliding contact with the photosensitive drum is provided (Japanese Patent Laid-Open No. 2010-8993).

A configuration is considered in which the developing cartridge serving as a developing unit, and a drum cartridge serving as a cleaning unit including a photosensitive drum are configured to be individually detachably attachable to an image forming apparatus main body. When such a configuration is adopted, the sheet member is separated from the photosensitive drum when the developing cartridge is attached and detached. With such a configuration, the scattering toner easily leaks in the image forming apparatus.

SUMMARY OF THE INVENTION

A first aspect of the present disclosure is a cartridge that is detachably attachable to an apparatus main body of an image forming apparatus, the cartridge including a developer bearing member that bears developer on a surface thereof, a frame that supports the developer bearing member so that the developer bearing member is rotatable, a developing blade including a regulating member that regulates a thickness of a layer of the developer borne on the surface of the developer bearing member, and a support member that is fixed to the frame and that supports the regulating member, and a collecting member that collects the developer scattered from the developer bearing member, the collecting member including a containing portion that is supported by the support member and contains the developer that has been collected, the containing portion including an opening through which the developer is collected and which opposes the developer bearing member, the containing portion extending in a rotational axis direction of the developer bearing member, a sectional area of a longitudinal end portion area of the containing portion, orthogonal to the rotational axis direction, corresponding to a longitudinal end portion of the developer bearing member being larger than that of a longitudinal middle portion area, orthogonal to the rotational axis direction, corresponding to a middle portion of the developer bearing member.

A second aspect of the present disclosure is a cartridge that is detachably attachable to an apparatus main body of an image forming apparatus, the cartridge including a developer bearing member that bears developer on a surface thereof, a frame that supports the developer bearing member so that the developer bearing member is rotatable, a developing blade including a regulating member that regulates a thickness of a layer of the developer borne on the surface of the developer bearing member, and a support member that is fixed to the frame and that supports the regulating member, and a collecting member that collects the developer scattered from the developer bearing member, the collecting member including a containing portion that is supported by the support member and contains the developer that has been collected, the containing portion including an opening through which the developer is collected and which opposes the developer bearing member, the containing portion extending in a rotational axis direction of the developer bearing member, a width of the opening, perpendicular to the rotational axis direction, in an longitudinal end portion area of the containing portion corresponding to a longitudinal end portion of the developer bearing member being larger than that in a longitudinal middle portion area of the containing portion corresponding to a longitudinal middle portion of the developer bearing member.

A third aspect of the present disclosure is a cartridge that is detachably attachable to an apparatus main body of an image forming apparatus, the cartridge including a developer bearing member that bears developer on a surface thereof, a frame that supports the developer bearing member so that the developer bearing member is rotatable, a developing blade including a regulating member that regulates a thickness of a layer of the developer borne on the surface of the developer bearing member, and a support member that is fixed to the frame and that supports the regulating member, and a collecting member that collects the developer scattered from the developer bearing member, the collecting member including a containing portion that is supported by the support member and contains the developer that has been collected, the containing portion including an opening through which the developer is collected and which opposes the developer bearing member, and including a restricting portion that restricts the developer contained in the containing portion from moving in a direction from a longitudinal end portion area to a longitudinal middle portion area of the containing portion and that extends in a direction approaching the developer bearing member as the restricting portion extends form the longitudinal end portion to the longitudinal middle portion of the developer bearing member.

Further features of the present invention will become apparent from the following description of exemplary embodiments with reference to the attached drawings.

DESCRIPTION OF THE EMBODIMENTS

First Exemplary Embodiment

Schematic Configuration of Overall Image Forming Apparatus

Overall Configuration of Image Forming Apparatus

Figure 2:
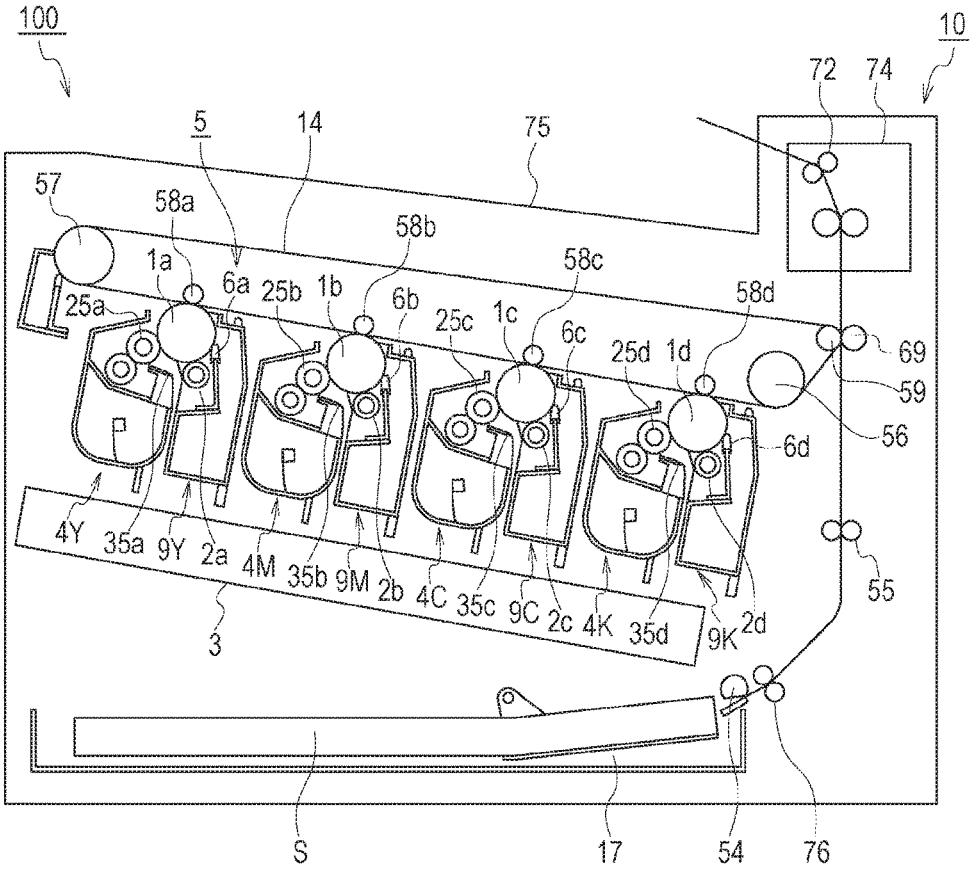
FIG. 2 is a cross-sectional view am electrophotographic image forming apparatus according to the exemplary embodiment of the present disclosure.

An overall configuration of an electrophotographic image forming apparatus (hereinafter, referred to as an image forming apparatus) 100 rill be described with reference to FIG. 2. As illustrated in FIG. 2, the image forming apparatus 100 includes detachably attachable four drum cartridges 9 (9Y, 9M, 9C, and 9K) and four developing apparatuses (hereinafter, developing cartridges) 4 (4Y, 4M, 4C, and 4K) mounted in an image forming apparatus main body (hereinafter, referred to as an apparatus main body) 10. Furthermore, the upstream side of the image forming apparatus 100 in a mounting direction of the drum cartridges 9 and the developing cartridges 4 is defined as a front surface side, and the downstream side in the mounting direction is defined as a rear surface side. In FIG. 2, the drum cartridges 9 and the developing cartridges 4 are arranged inside the apparatus main body 10 so as to be inclined against the horizontal direction.

The drum cartridges 9 includes process members, such as electrophotographic photoconductors (hereinafter, referred to as photosensitive drums) 1 (1*a*, 1*b*, 1*c*, and 1*d*), and charge rollers 2 (2*a*, 2*b*, 2*c*, and 2*d*) and cleaning members 6 (6*a*, 6*b*, 6*c*, and 6*d*) on the circumferences of the photosensitive drums 1, in an integrated manner.

Furthermore, the developing cartridges 4 (4Y, 4M, 4C, and 4K) include process members, such as developer bearing members (hereinafter, development rollers) 25 (25*a*, 25*b*, 25*c*, and 25*d*) and regulating members (hereinafter, referred to as developing blades) 35 (35*a*, 35*b*, 35*c*, and 35*d*), in an integrated manner. The developing cartridges 4 do not include the photosensitive drums 1.

The charge rollers 2 are members that uniformly charge surfaces of the photosensitive drums 1, and the development rollers 25 are members that turn latent images formed on the photosensitive drums 1 into visible images by developing the latent images with developer (hereinafter, toner). Furthermore, the cleaning members 6 are members that remove residual toner on the photosensitive drums 1 after the toner images formed on the photosensitive drums 1 have been transferred onto a recording medium S.

Furthermore, a scanner unit 3 that selectively exposes the photosensitive drums 1 on the basis of image information to form latent images on the photosensitive drums 1 are provided below the drum cartridges 9 and the developing cartridges 4.

Furthermore, a cassette 17 that contains recording mediums S are mounted below the scanner unit 3. Furthermore, recording medium conveying members are provided so that the recording medium S is conveyed above the image forming apparatus main body 10 through a secondary transfer roller 69 and a fixing portion 74. In other words, the recording medium conveying members include a feed roller 54 that separates and feeds the recording mediums S, sheet by sheet, in the cassette 17, a pair of convey rollers 76 that conveys the fed recording medium S, and a pair of registration rollers 55 that synchronizes the latent images formed on the photosensitive drums 1 and the recording medium S. Furthermore, an intermediate transfer unit 5 serving as an intermediate transfer member that transfers the toner images formed on the photosensitive drums 1 (1*a*, 1*b*, 1*c*, and 1*d*) is provided above the drum cartridges 9 and the developing cartridges 4. The intermediate transfer unit 5 includes a driving roller 56, a driven roller 57, primary transfer rollers 58 (58*a*, 58*b*, 58*c*, and 58*d*) at positions that oppose the photosensitive drums 1 of various colors, and an opposed roller 59 at a position opposing the secondary transfer roller 69, which a transfer belt 14 is stretched across. Furthermore, by circulating and moving the transfer belt 14 so that the transfer belt 14 opposes and is in contact with all of the photosensitive drums 1, and by applying a voltage to the primary transfer rollers 58 (58*a*, 58*b*, 58*c*, and 58*d*), primary transfer from the photosensitive drums 1 onto the transfer belt 14 is performed. Moreover, by applying voltage to the opposed roller 59 disposed inside the transfer belt 14 and to the secondary transfer roller 69, toner on the transfer belt 14 is transferred to the recording medium S.

When images are formed, the photosensitive drums 1 are rotated and the photosensitive drums 1 that have been uniformly charged with the charge rollers 2 are selectively exposed by the scanner unit 3. With the above, electrostatic latent images are formed on the photosensitive drums 1. The latent images are developed with the development rollers 25. With the above, toner images of various colors are formed on the photosensitive drums 1.

Synchronizing with the formation of the images, the pair of registration rollers 55 conveys the recording medium S to the secondary transfer position where the opposed roller 59 and the secondary transfer roller 69 abut against each other with the transfer belt 14 interposed in between. Furthermore, by applying a transfer bias voltage to the secondary transfer roller 69, the toner images of various colors on the transfer belt 14 is secondarily transferred onto the recording medium S. With the above, a color image is formed on the recording medium S. The recording medium S on which a color image has been formed is heated and compressed in the fixing portion 74 to fix the toner image. Subsequently, the recording medium S is discharged to a discharge portion 75 with a discharge roller 72. Note that the fixing portion 74 is disposed in the upper portion of the image forming apparatus 100.

Drum Cartridges

Figure 3:
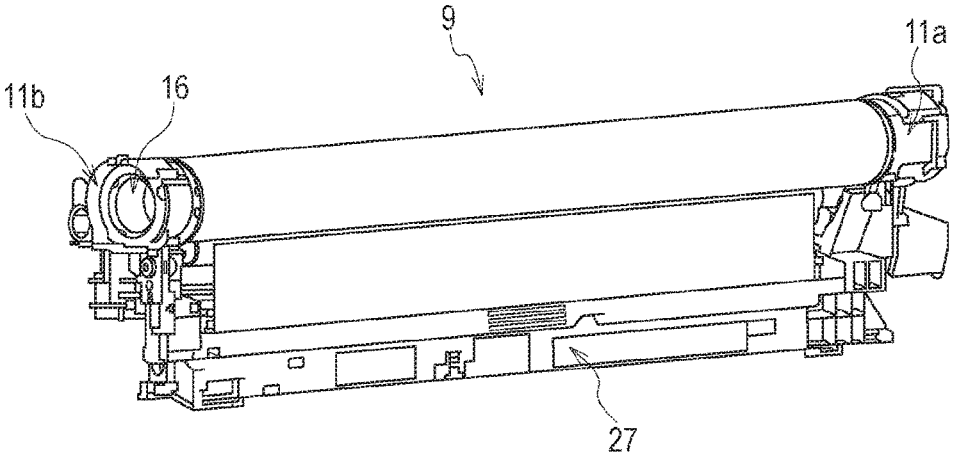
FIG. 3 is a perspective view of a drum cartridge according to the exemplary embodiment of the present disclosure.
Figure 4:
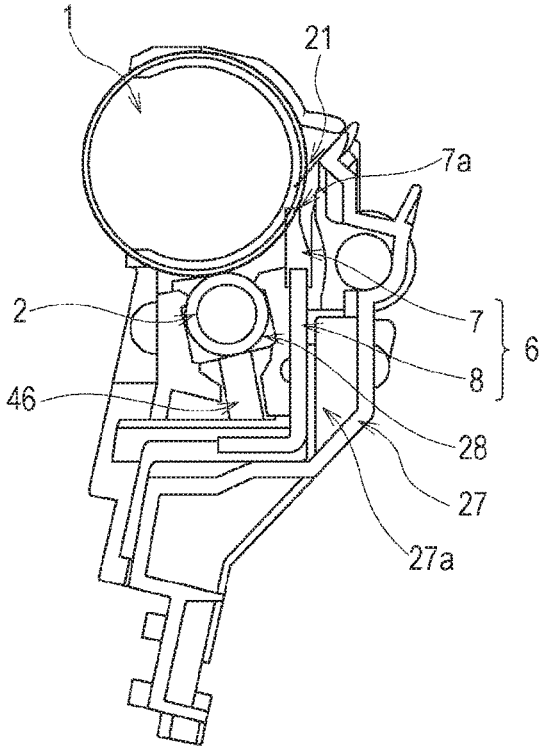
FIG. 4 is a cross-sectional view of a drum cartridge according to the exemplary embodiment of the present disclosure.

Referring next to FIGS. 3 and 4, the drum cartridges 9 (9Y, 9M, 9C, and 9K) embodying the present disclosure will be described. FIG. 3 is an explanatory drawing illustrating a configuration of the drum cartridge 9. Furthermore, FIG. 4 is a cross-sectional view of the drum cartridge 9. Note that the drum cartridges 9Y, 9M, 9C, and 9K have the same configuration.

The photosensitive drum 1 is rotatably provided in a cleaning frame 27 of the drum cartridge 9 with a drum front bearing 11*a* and a drum rear bearing 11*b* in between. A drum coupling 16 and a flange are provided on a first end side of the photosensitive drum 1 in an axial direction (a longitudinal direction).

As described above, the charge roller 2 and the cleaning member 6 are provided on the circumference of the photosensitive drum 1. The cleaning member 6 includes a rubber blade 7 serving as an elastic member, and a cleaning support member 8. A distal end 7*a* of the rubber blade 7 is disposed so as to abut against the photosensitive drum 1 in a direction countering the rotation direction of the photosensitive drum 1. Furthermore, the residual toner removed from the surface of the photosensitive drum 1 with the cleaning member 6 falls into a removed toner chamber 27*a*. Furthermore, a scoop sheet 21 is attached to the cleaning frame 27 and is abutted against the photosensitive drum 1 to prevent the removed toner in the removed toner chamber 27*a* from leaking out. Furthermore, by transmitting driving force of a main body driving motor (not shown) that is a drive source to the drum cartridge 9, the photosensitive drum 1 is rotationally driven in accordance with the image forming operation. The charge roller 2 is rotatably attached to the drum cartridge 9 through the charge roller bearing 28, is pressed against the photosensitive drum 1 with a charge roller pressing member 46 so as to be rotated by the photosensitive drum 1.

Developing Cartridge

Figure 5:
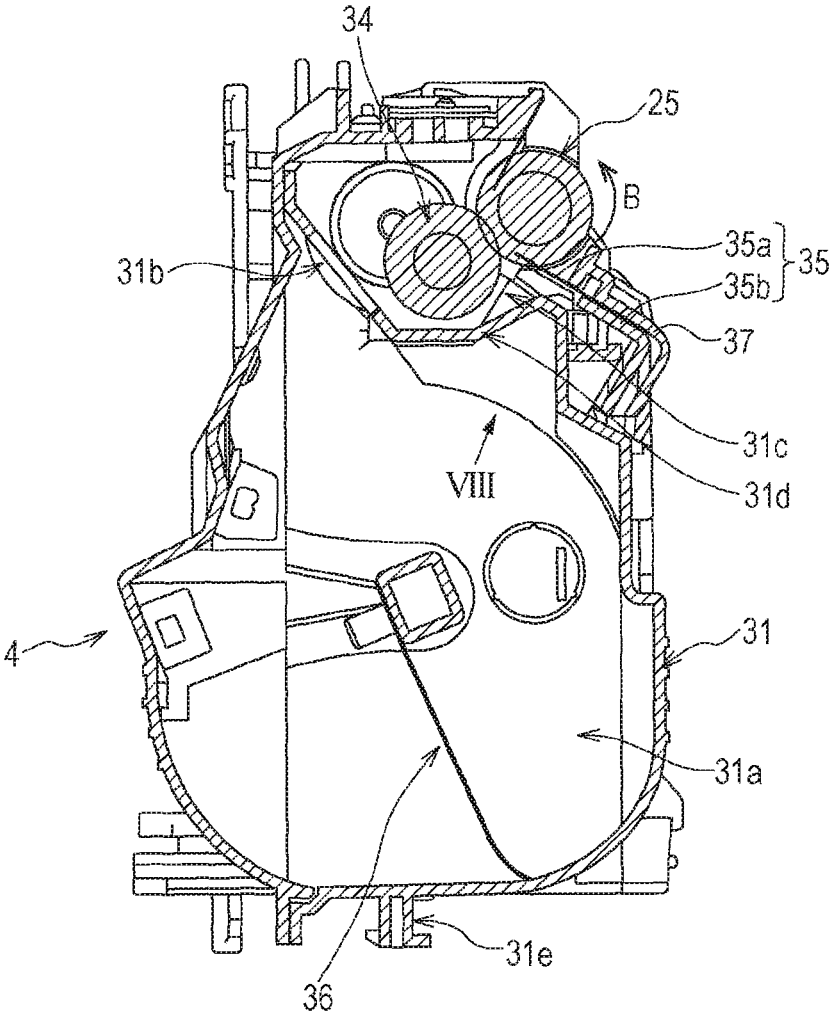
FIG. 5 is a cross-sectional view of a developing cartridge according to the exemplary embodiment of the present disclosure.

Referring next to FIG. 5, the developing cartridges 4 (4Y, 4M, 4C, and 4K) will be described. FIG. 5 is a cross-sectional view of the developing cartridge 4 containing toner. Note that the developing cartridge 4Y containing yellow toner, the developing cartridge 4M containing magenta toner, the developing cartridge 4C containing cyan toner, and the developing cartridge 4K containing black toner have the same configuration.

The developing cartridge 4 includes the development roller 25, a toner feeding roller 34 that is rotated by being in contact with the development roller 25, a developing blade 35 that regulates the toner layer on the development roller 25, a toner conveying member 36, and a developing frame 31 that supports the toner conveying member 36.

The developing frame 31 includes a developing chamber 31*c* in which the development roller 25 and the toner feeding roller 34 are disposed, and a toner containing chamber 31*a* provided below the developing chamber 31*c*. The chambers are partitioned from each other by a partition 31*d*. Furthermore, an opening 31*b* through which the toner passes when the toner is conveyed from the toner containing chamber 31*a* to the developing chamber 31*c* is provided in the partition 31*d*. Moreover, the developing frame 31 includes a bias portion 31*e*. The bias portion 31*e* is biased by a biasing member (not shown) of the image forming apparatus 100 when the developing frame 31 is moved relative to the drum cartridge 9.

Figure 11:
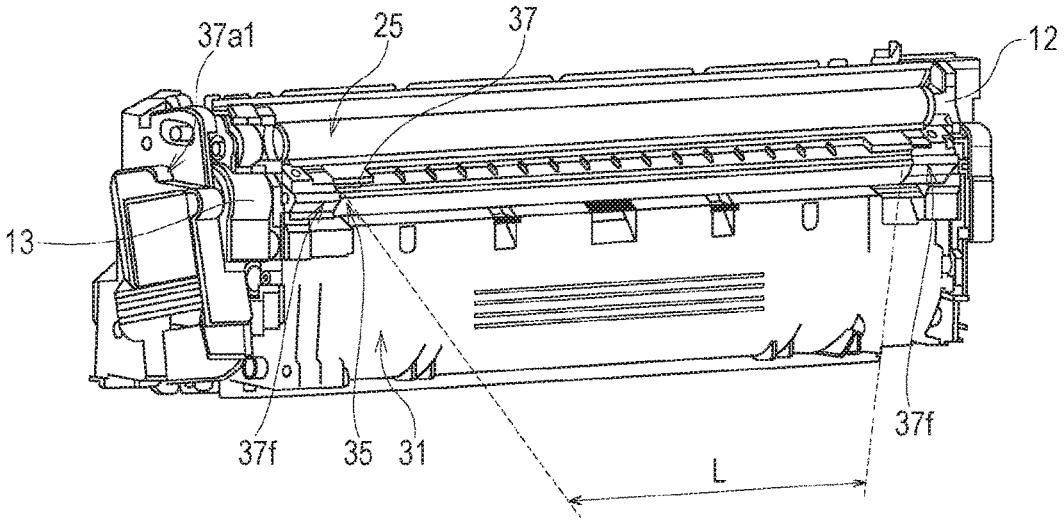
FIG. 11 is a perspective view of the developing cartridge according to the exemplary embodiment of the present disclosure.

The development roller 25 and the toner feeding roller 34 are rotatably supported by a developing unit rear bearing 12 and a developing unit front bearing 13 that are provided on the two sides in the development roller axial direction (the longitudinal direction) and that constitute the frame together with the developing frame 31 (FIG. 11). In a state in which the toner is fed from the toner feeding roller 34 to the development roller 25 and in which the development roller 25 is in contact with the photosensitive drum 1, the development roller 25 is rotated in an arrow B direction to develop the latent image formed on the surface of the photosensitive drum 1 with toner. Note that the developing blade 35 includes the regulating portion 35*a* that regulates the thickness of the toner layer on the development roller 25 by contacting the development roller 25, and a support portion 35*b* that is fixed to the developing frame 31 and that supports the regulating portion 35*a*. In the present exemplary embodiment, a portion of the regulating portion 35*a* of the developing blade 35 is disposed vertically below the development roller 25.

The toner containing chamber 31*a* of the developing frame 31 is provided with the toner conveying member 36 that mixes the contained toner and that conveys the toner to the developing chamber 31*c* through the opening 31*b*.

Figure 6:
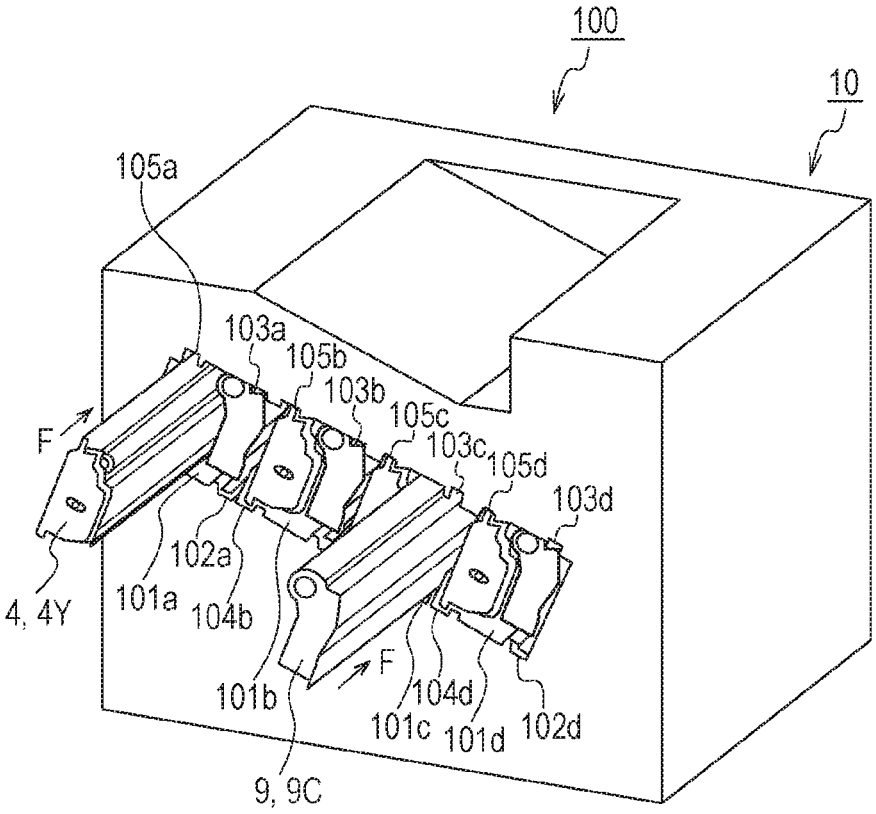
FIG. 6 is a block diagram of drum cartridges and developing cartridges according to the exemplary embodiment of the present disclosure.

Configuration Inserting and Mounting Drum Cartridges and Developing Cartridges into Apparatus Main Body Referring next to FIG. 6, a configuration to insert the drum cartridges 9 and the developing cartridges 4 in the apparatus main body 10 of the image forming apparatus 100 will be described. Note that in the present exemplary embodiment, the drum cartridges 9 (9Y, 9M, 9C, and 9K) and the developing cartridges 4 (4Y, 4M, 4C, and 4K) are inserted into openings 101 (101*a*, 101*b*, 101*c*, and 101*d*) of the apparatus main body 10 in a direction depicted by an arrow F in the drawing, that is, from the front side towards the rear side. In other words, the drum cartridges 9 and the developing cartridges 4 are inserted in a direction parallel to the axial direction of the photosensitive drums 1 (1*a*, 1*b*, 1*c*, and 1*d*). In the present exemplary embodiment, the upstream side of the drum cartridges 9 and the developing cartridges 4 in the insertion direction is defined as the front side, and the downstream side is defined as the rear side.

The apparatus main body 10 includes main body mounted upper guide portions 103 (103*a*, 103*b*, 103*c*, and 103*d*) that are first main body guide portions on the vertically upper side, and main body mounted lower guide portions 102 (102*a*, 102*b*, 102*c*, and 102*d*) that are second main body guide portions on the vertically lower side. The main body mounted upper guide portions 103 and the main body mounted lower guide portions 102 each have a guiding shape that extends in an insertion direction F of the drum cartridges 9. The drum cartridge 9 is inserted into the apparatus main body 10 by placing the drum cartridge 9 on the front side of the main body mounted lower guide portion 102 in the mounting direction and by moving the drum cartridge 9 in the insertion direction F along the main body mounted upper guide portion 103 and the main body mounted lower guide portion 102.

The process of inserting the developing cartridge 4 is similar to that of the drum cartridge 9. The apparatus main body 10 is provided with main body mounted upper guide portions 105 (105*a*, 105*b*, 105*c*, and 105*d*) on the vertically upper side, and main body mounted lower guide portions 104 (104*a*, 104*b*, 104*c*, and 104*d*) on the vertically lower side. The main body mounted upper guide portions 105 and the main body mounted lower guide portions 104 each have a guiding shape that extends in an insertion direction F of the developing cartridges 4. The developing cartridge 4 is inserted into the apparatus main body 10 by placing the developing cartridge 4 on the front side of the main body mounted lower guide portion 104 in the mounting direction and by moving the developing cartridge 4 in the insertion direction F along the main body mounted upper guide portion 105 and the main body mounted lower guide portion 104.

Figure 1:
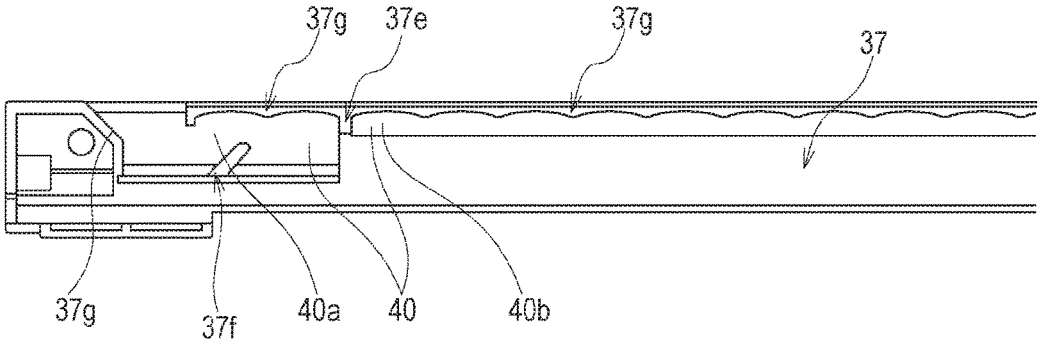
FIG. 1 is an enlarged view illustrating, in a partial manner, a configuration of a collecting member of an exemplary embodiment of the present disclosure.
Figure 7:
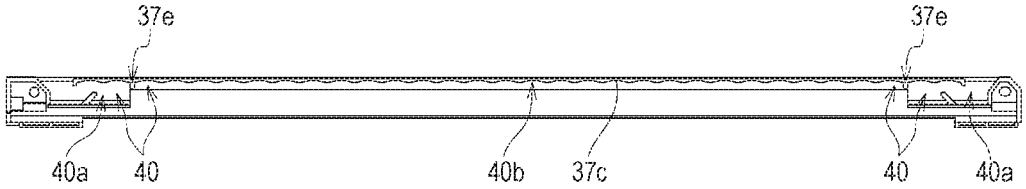
FIG. 7 is a diagram illustrating a configuration of the collecting member of the exemplary embodiment of the present disclosure.
Figure 8:
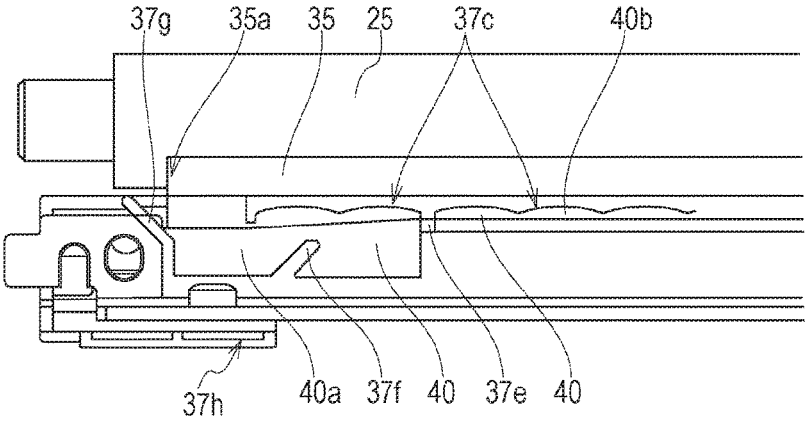
FIG. 8 is a perspective view near the collecting member of the exemplary embodiment of the present disclosure.
Figure 9:
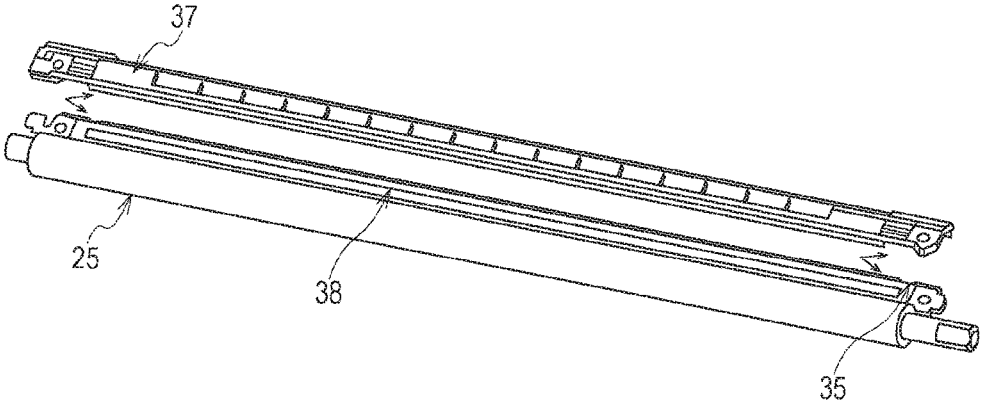
FIG. 9 is a diagram illustrating disposition of members near the collecting member of the developing cartridge according to the exemplary embodiment of the present disclosure.

Referring next to FIGS. 1, 5, and 7 to 11, a configuration of a collecting member 37 of the developing cartridge 4 according to an exemplary embodiment of the present disclosure will be described. FIG. 1 is a partially enlarged view of the collecting member 37 that prevents the toner that has been regulated by the developing blade 35 from scattering outside the developing cartridge 4. FIG. 7 is a schematic view illustrating the configuration of the collecting member 37. FIG. 8 is a drawing of FIG. 5 seen from direction VIII. FIG. 9 is a drawing illustrating the disposition of each member when the collecting member 37 is in an assembled state. FIGS. 10A and 10B are cross-sectional views near the collecting member 37 illustrated in FIG. 8 in a state in which a developing cartridge 4 is mounted in an apparatus main body 10 positioned so that the vertically upper side is the upper side of the drawing. FIG. 11 is a perspective view of the developing cartridge 4.

Figure 10A:
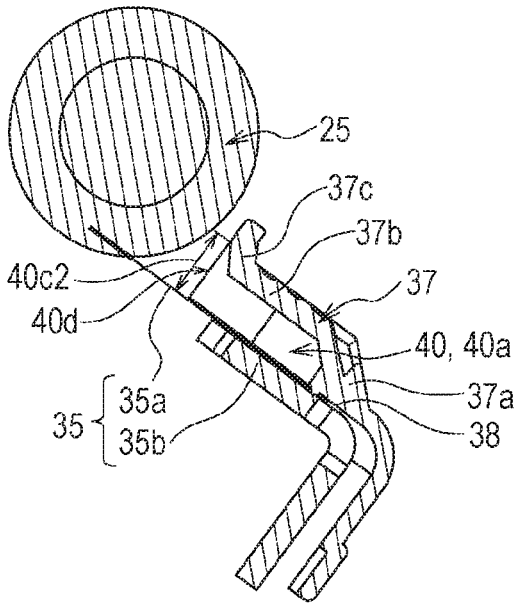
FIGS. 10A and 10B are cross-sectional views near the collecting member of the developing cartridge according to the exemplary embodiment of the present disclosure.
Figure 10B:
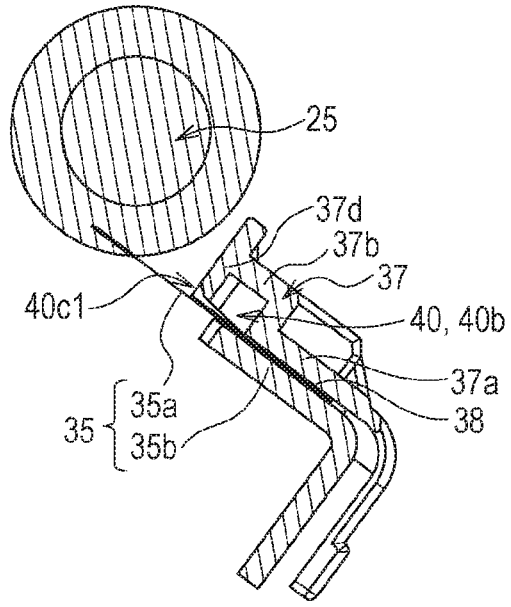

In a cross section perpendicular to a longitudinal direction (a rotational axis direction) of the development roller 25, the collecting member 37 includes, in order from the support portion 35*b* side of the developing blade 35 towards a free end portion side of the regulating portion 35*a*, a connection 37*a* and an opposing portion 37*b* (FIGS. 10A and 10B). Furthermore, as illustrated in FIG. 10A, a collecting portion 37*c* is provided at a longitudinal end portion continuous to the opposing portion 37*b* and, meanwhile, as illustrated in FIG. 10B, a toner barbed portion 37*d* is provided at a longitudinal middle portion continuous to the opposing portion 37*b*. In a direction perpendicular to the longitudinal direction of the development roller 25, the collecting portion 37*c* is an end portion of the collecting member 37 that is on the side closer to the development roller 25, and the collecting portion 37*c* is shaped so that the collecting portion 37*c* becomes more distanced away from the support portion 35*b* as the collecting portion 37*c* becomes closer to the development roller 25. The connection 37*a* is directly or indirectly fixed to the developing blade 35 and is fixed so that a set space is formed between the opposing portion 37*b* and the developing blade 35. As described above, the connection 37*a* is a portion that connects the opposing portion 37*b* and the developing blade 35 to each other, is configured so that the cross section of the opposing portion 37*b*, the connection 37*a*, and the developing blade 35 forms a recessed shape, and is configured so that toner is stored therein. In the present exemplary embodiment, toner can be stored by disposing the collecting member 37 vertically above the developing blade 35 and indirectly fixing the connection 37*a* and the developing blade 35 to each other with a two-sided adhesive tape 38 (FIG. 9). Note that herein, vertically above is a position determined when the developing cartridge 4 is mounted, in the image forming apparatus main body 10, at a position that allows formation of image. Hereinafter, when vertically above and vertically below are used, the developing cartridge 4 is in the above described position.

The collecting member 37 is configured so that, at the longitudinal middle portion, a first end of the opposing portion 37*b* is connected to the connection 37*a*, and a second end is connected to the toner barbed portion 37*d*. In the toner barbed portion 37*d*, a second end extends from a first end that is connected to the opposing portion 37*b* towards the developing blade 35, and the toner barbed portion 37*d* is disposed so that a gap 40*c*1 is formed (at a containing portion inlet) between the second end and the developing blade 35. A containing portion 40 having a blind alley-shaped cross section open between the toner barbed portion 37*d* and the developing blade 35 is formed with the collecting member 37 and the developing blade 35 in the above manner. Note that the toner barbed portion 37*d* may be any kind of member that collects the toner in the containing portion 40 through the gap 40*c*1 and, for example, a portion or all of the surface that opposes the developing blade 35 may be chamfered so that the surface is not orthogonal to the developing blade 35.

Figure 12A:
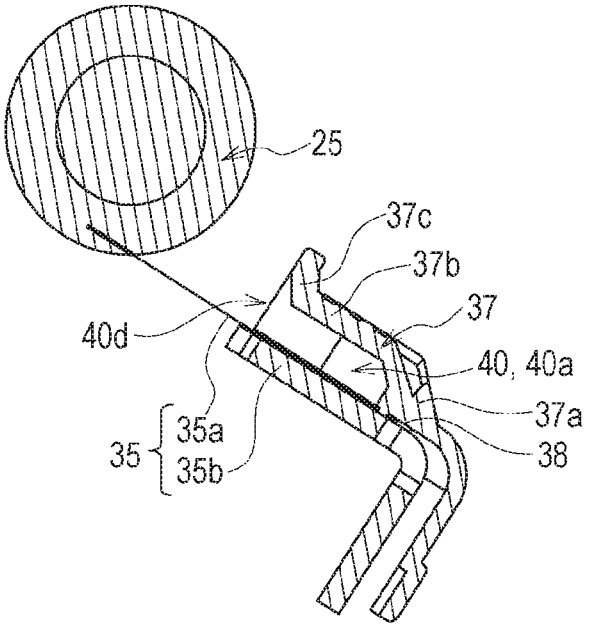
FIGS. 12A and 12B are cross-sectional views near the collecting member of the developing cartridge according to a modification example of the exemplary embodiment of the present disclosure.
Figure 12B:
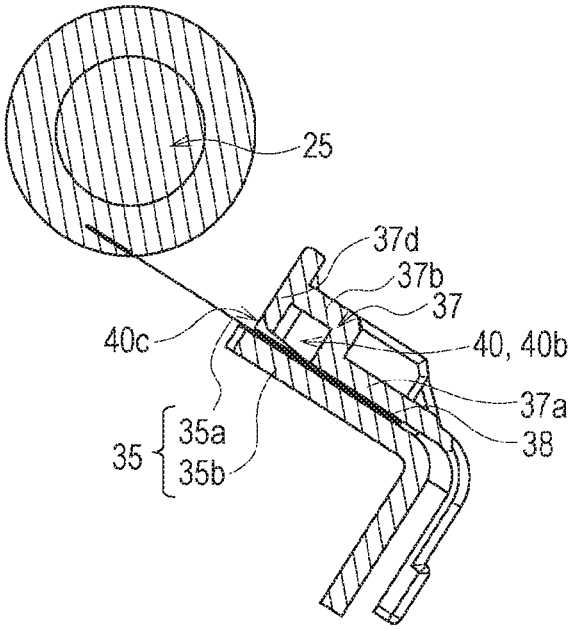

On the other hand, the collecting member 37 is configured so that, at the longitudinal end portion, the first end of the opposing portion 37*b* is connected to the connection 37*a*, and the second end is connected to the collecting portion 37*c*. The collecting portion 37*c* is shaped so that the second end extends towards the development roller 25 from the first end that is connected to the opposing portion 37*b*. A taking-in portion 40*d* is formed between the second end of the collecting portion 37*c* and the developing blade 35 (the opening). The taking-in portion 40*d* is formed of a gap that is larger than the gap 40*c*1 at the longitudinal middle portion. The taking-in portion 40*d* has a tapered shape in which a width of the opening is gradually widen toward the development roller. As described above, in the present exemplary embodiment, at least a portion of the developing blade 35 is disposed vertically below the photosensitive drum 1. Furthermore, the collecting member 37 is disposed downstream in the rotation direction (arrow B) of the development roller 25 with respect to the developing blade 35 so as to partially overlap the developing blade 35, in other words, the collecting member 37 is disposed vertically above the developing blade 35 so that the containing portion 40 is formed. Even in a case in which the toner removed from the development roller 25 with the regulating portion 35*a* of the developing blade 35 scatters (falls vertically downwards), the toner moves along the developing blade 35 from the regulating portion 35*a* of the developing blade 35 towards the support portion 35*b*. Furthermore, the toner is received in the containing portion 40. Note that since it is only sufficient that the toner moves along the developing blade 35 and is received in the containing portion 40, the configuration may be such that at least a portion of the developing blade 35 is positioned vertically below the development roller 25, and a portion of the developing blade 35 is not positioned vertically below the photosensitive drum 1. Furthermore, as illustrated in FIG. 12 in which the upper side of the drawing is the vertically upper side, at least a portion of the developing blade 35 may be positioned vertically below the development roller 25, and the collecting member 37 provided so as to cover a portion of the developing blade 35 may not be positioned vertically below the photosensitive drum 1 (not shown).

In the present exemplary embodiment in particular, the collecting portion 37*c* is provided at the longitudinal end portion. With the above, a large amount of toner is regulated at the developing blade 35, for example. Accordingly, even if the toner cannot be contained in the containing portion 40 through the gap 40*c* at the longitudinal middle portion, the toner can be contained in the containing portion 40 in a more reliable manner through the taking-in portion 40*d*. In other words, the toner that could not be contained in the containing portion 40 through the gap 40*c* at the longitudinal middle portion moves along the developing blade 35 and the collecting member 37, and can contained in the containing portion 40 through the taking-in portion 40*d* so as to be guided by the collecting portion 37*c*.

Furthermore, in the present exemplary embodiment, as illustrated in FIG. 7, the containing portion 40 in the longitudinal direction is separated into containing end portions 40*a* (end portion areas) at the two ends and a containing middle portion 40*b* (a middle portion area). Specifically, as illustrated in FIG. 1, rib-shaped movement suppressing portions 37*e* are provided between the containing end portions 40*a* and the containing middle portion 40*b*. The movement suppressing portions 37*e* function as partitioning portions that partially partition the containing end portions 40*a* and the containing middle portion 40*b* of the containing portion 40 from each other. The space between the developing blade 35 and the movement suppressing portions 37*e* are smaller than the space between the developing blade 35 and the opposing portion 37*b*. With the above, even when the toner contained in the containing end portions 40*a* move in the longitudinal direction, the movement of the toner is restricted by the movement suppressing portions 37*e* so that movement of the toner from the containing end portions 40*a* to the containing middle portion 40*b* is restricted and, accordingly, leaking of the toner to the outside can be suppressed.

Additionally, end portion barbed ribs 37*f* that are rib-shaped projecting portions that project from the connection 37*a* side towards the toner barbed portion 37*d* are provided inside the containing end portions 40*a*. The end portion barbed ribs 37*f* are inclined towards the middle portion in the longitudinal direction as the end portion barbed ribs 37*f* extend from the containing portion 40 side towards the toner barbed portion 37*d* side. The end portion barbed ribs 37*f* function as, in the containing end portions 40*a*, restricting portions that restrict the toner contained in the containing end portions 40*a* from moving from the longitudinal end portions towards the longitudinal middle portion of the development roller 25. The end portion barbed ribs 37*f* each extends in a direction approaching the development roller 25 as the end portion barbed ribs 37*f* extend from the longitudinal end portion towards the longitudinal middle portion of the development roller 25. In the containing portion 40, the end portion barbed ribs 37*f* are positioned between the developing blade 35 and the opposing portion 37*b*. Even when the toner moves inside the containing end portions 40*a* in the longitudinal direction, the scattering toner is caught by the end portion barbed ribs 37*f* and the movement of the toner in the longitudinal direction is suppressed. Accordingly, as illustrated in FIG. 7, the toner that is contained in the containing end portion 40*a* on the first end side can be suppressed from passing through the containing middle portion 40*b*, from being blown out from the containing end portion 40*a* on a second end side, and from scattering.

As described above, by providing the movement suppressing portions 37*e* and the end portion barbed ribs 37*f*, the toner contained in the containing portion 40 can be prevented from being blown out even when, for example, the user holds the developing cartridges 4 in an inclined manner with respect to the horizontal direction. As a result, leaking of the toner from the developing cartridge 4 can be prevented.

Furthermore, as illustrated in FIG. 8, the toner that has been scattered from an end portion 35*a* of the developing blade is collected into the containing end portion 40*a* with a collecting surface 37*g*. More toner scatters from the end portion 35*a* of the developing blade than from the middle portion of the developing blade. Accordingly, as illustrated in FIGS. 10A and 10B, when viewed in an axial direction of the development roller 25, the cross-sectional area of the containing end portion 40*a* (see FIG. 10A) is larger than that of the containing middle portion 40*b* (see FIG. 10B); accordingly, a larger amount of scattered toner can be collected.

Furthermore, in the present exemplary embodiment, the toner received in the containing portion 40 can be suppressed from leaking to the outside since the toner barbed portion 37*d* extends towards the developing blade 35 and the gap 40*c* with the developing blade 35 have been made small. However, on the other hand, the taking-in portion 40*d* is provided so as to extend towards the development roller 25 and form, with the developing blade 35, a gap 40*c*2 that is larger than the gap 40*c*1 between the toner barbed portion 7*d* and the developing blade 35 (FIG. 10). With the above, while suppressing toner from leaking to the outside from the containing portion 40, a large amount of toner can flow into the containing portion 40.

As described above, the present exemplary embodiment is capable of having a configuration in which the scattered toner does not leak to the apparatus main body 10 without being provided with a sheet member, as in the known art, that is in sliding contact with the photosensitive drum. Accordingly, even in a case in which the drum cartridges 9 and the developing cartridges 4 are individually attachable to and detachable from the apparatus main body 10, leakage of the scattered toner caused by the user attaching and detaching the developing cartridge 4 can be reduced. Furthermore, a configuration in which a sheet member does not slide against the photosensitive drum and in which the photosensitive drum does not become scratched can be obtained.

Note that in the present exemplary embodiment, as illustrated in FIG. 8, the collecting surface 37*g* is provided at both end portions of the collecting member 37 in the longitudinal direction to efficiently contain, in the containing portion 40, the toner scattered from the end portion of the regulating portion 35*a* of the developing blade 35 in contact with the development roller 25. In the longitudinal direction (the arrow F), at least a portion of the collecting surface 37*g* is positioned on the end portion side with respect to the regulating portion 35*a*. The collecting surface 37*g* is configured to incline from the inside towards the outside of the collecting portion 37 in the longitudinal direction from the support portion 35*b* side of the developing blade 35 towards the free end portion side of the regulating portion 35*a*. In the present exemplary embodiment, each collecting surface 37*g* is formed to extend over the corresponding end portion of the regulating portion 35*a*. With the above, the toner that has been removed from the development roller 25 at the longitudinal end portion with the regulating portion 35*a* can be moved along the collecting surface 37*g* from the regulating portion 35*a* side towards the support portion 35*b* side of the developing blade 35, and can be received into the containing portion 40 in a more suitable manner.

Furthermore, as illustrated in FIG. 7, on the free end portion side of the regulating portion 35*a* of the developing blade 35 in the direction orthogonal to the longitudinal direction, the inner wall surface of the toner barbed portion 37*d* opposing the containing portion 40 has a section in which a plurality of arc that are protrusions are connected in the longitudinal direction. With the above, when the toner received in the containing portion 40 moves in the longitudinal direction, the toner hits the returning portion 37*d*, and force from the regulating portion 35*a* side towards the support portion 35*b* side of the developing blade 35 can be exerted. As a result, the toner contained in the containing portion 40 in a more suitable manner can prevented from leaking.

Note that in the present exemplary embodiment, the inner wall surface of the toner barbed portion 37*d* on the free end portion side of the regulating portion 35*a* is configured to have a cross section in which a plurality of arc shapes that are protrusions are connected in the longitudinal direction; however, the shape of the inner wall surface of the toner barbed portion 37*d* is not limited to the above. It is only sufficient that the toner barbed portion 37*d* is capable of exerting force from the regulating portion 35*a* side towards the support portion 35*b* side of the developing blade 35 to the toner at the toner barbed portion 37*d* with the toner barbed portion 37*d* when the toner received in the containing portion 40 moves in the longitudinal direction. Accordingly, for example, the toner barbed portion 37*d* may include a surface that includes a component in the direction that intersects the longitudinal direction and may be formed with a surface including a plurality of unevenness.

Note that since the support portion 35*b* of the developing blade 35 supports the regulating portion 35*a*, a member that has a predetermined strength, such a metal sheet, is used as the support portion 35*b*. Accordingly, in the present exemplary embodiment, a metal sheet is uses as the support portion 35*b*. Accordingly, a coating portion 37*h* that covers the support portion 35*b* of the developing blade 35 is provided in the collecting member 37 so that the light emitted from the scanner unit 3 reflexed by the support portion 35*b* does not expose the photosensitive drum 1.

Note that in the exemplary embodiment described above, for example, the collecting member 37 is indirectly fixed to the developing blade 35 using a two-sided adhesive tape to suppress toner leakage. However, not limited to the above, the collecting member 37 may be fixed to the developing blade 35 with an adhesive agent or a hot melt. Furthermore, without having an adhesive member interposed in between, the collecting member 37 and the developing blade 35 may be in direct contact with each other by being in pressure contact with a screw or the like.

Furthermore, in the exemplary embodiment described above, the collecting surface 37*g* is configured to incline from the inside towards the outside of the collecting member 37 in the longitudinal direction from the support portion 35*b* side of the developing blade 35 towards the free end portion side of the regulating portion 35*a*. However, the collecting surface 37*g* may be configured to have a stepped shape from the inside towards the outside of the collecting member 37 in the longitudinal direction from the support portion 35*b* side of the developing blade 35 towards the free end portion side of the regulating portion 35*a*. As described above, the exemplary embodiment described above can be modified in various manners within the scope of the present disclosure.

Second Exemplary Embodiment

In the present exemplary embodiment, referring to FIGS. 13A to 18, other exemplary embodiments regarding e shape of the end portions of the collecting member in the longitudinal direction will be described. Note that the basic configuration of the developing cartridge and the configuration attaching and detaching the developing cartridge to the image forming apparatus are similar to those of the first exemplary embodiment, and description thereof will be omitted.

Figure 13A:
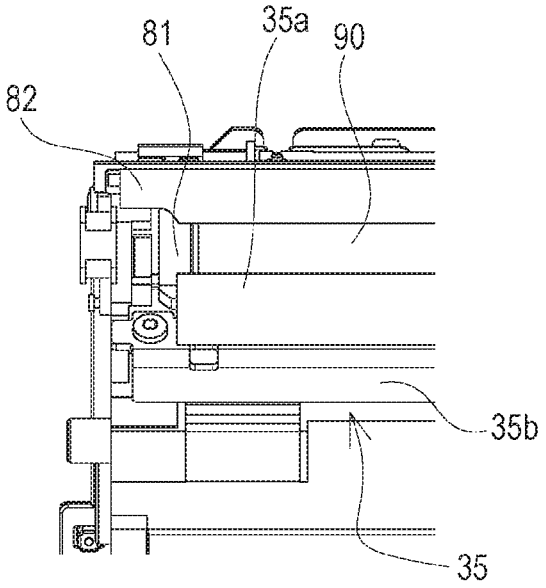
FIGS. 13A and 13B are enlarged views illustrating, in a partial manner, the developing cartridge according to the exemplary embodiment of the present disclosure.
Figure 13B:
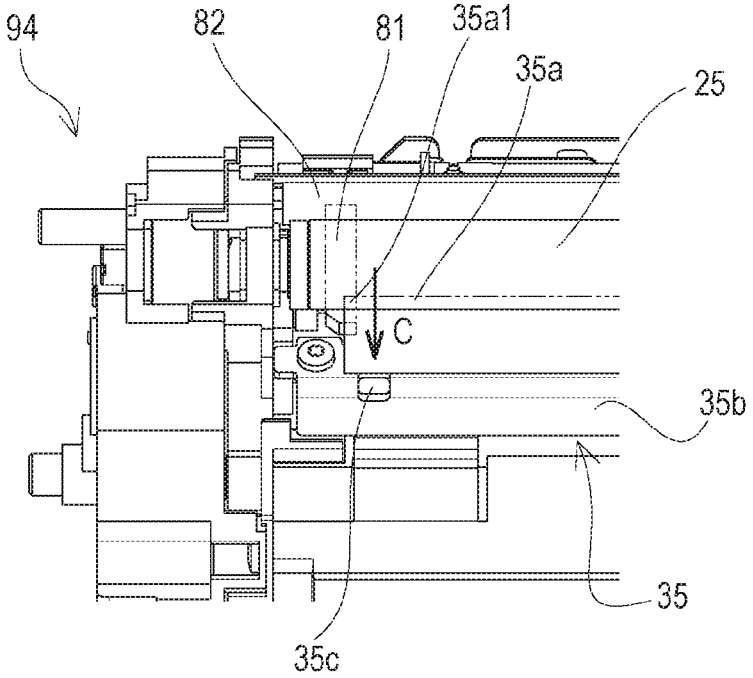
Figure 14:
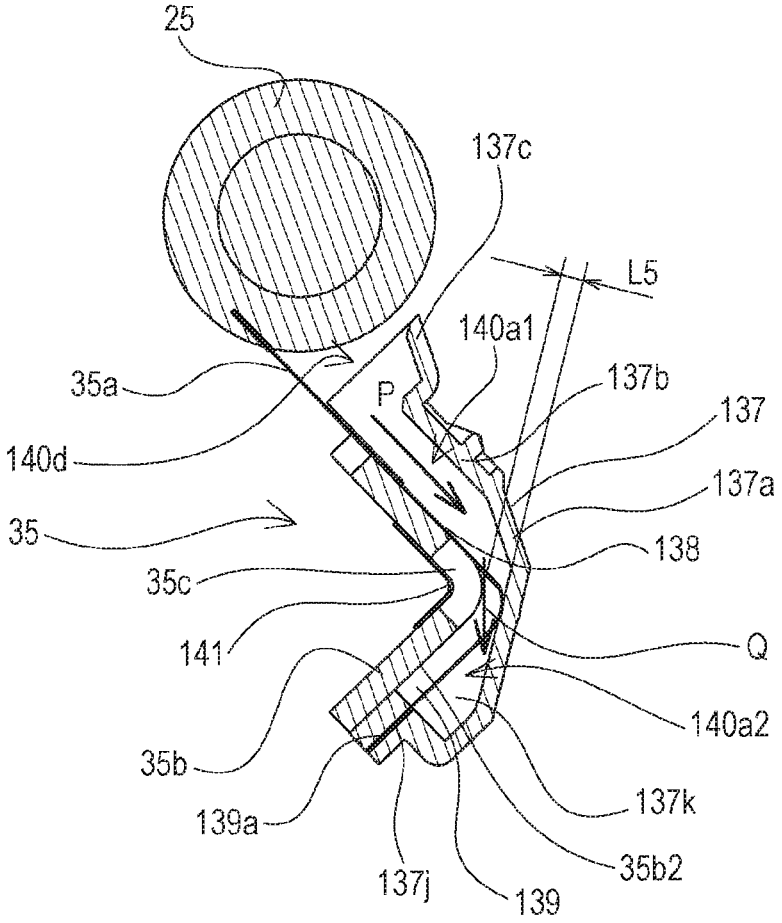
FIG. 14 is a cross-sectional view near the collecting member of the developing cartridge according to the exemplary embodiment of the present disclosure.
Figure 15A:
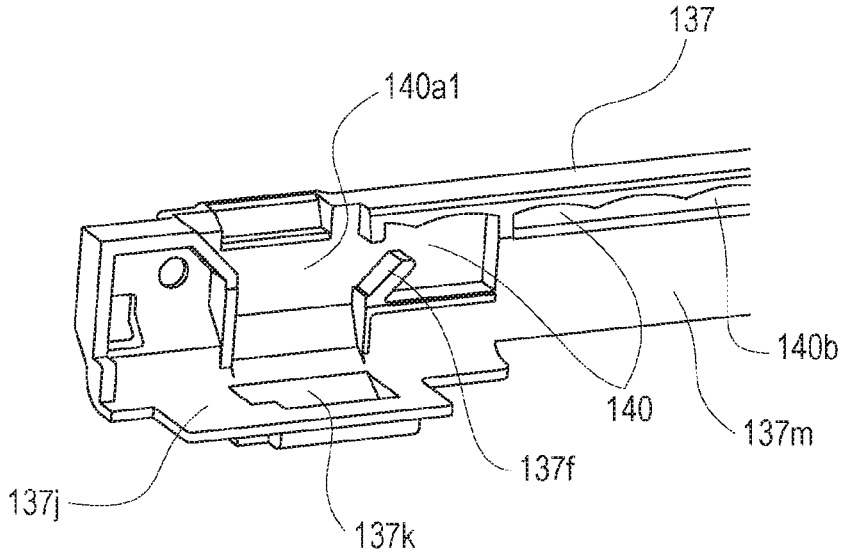
FIGS. 15A and 15B are perspective views illustrating a configuration of the collecting member of the exemplary embodiment of the present disclosure.
Figure 15B:
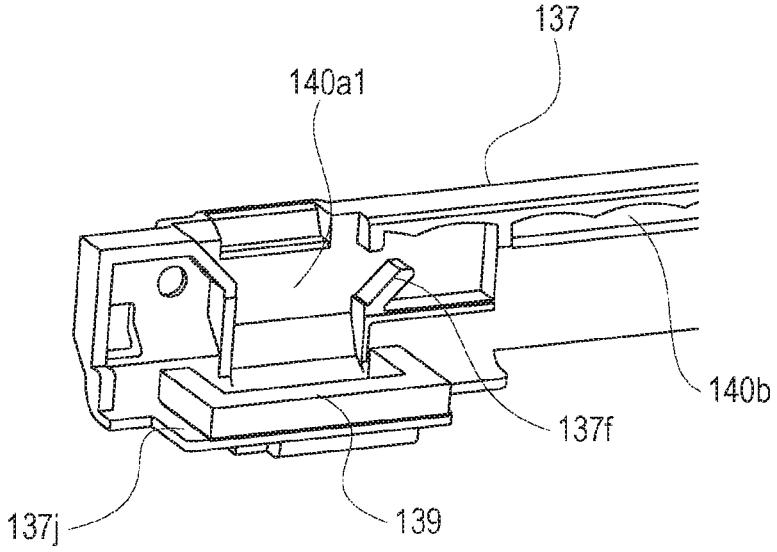
Figure 16:
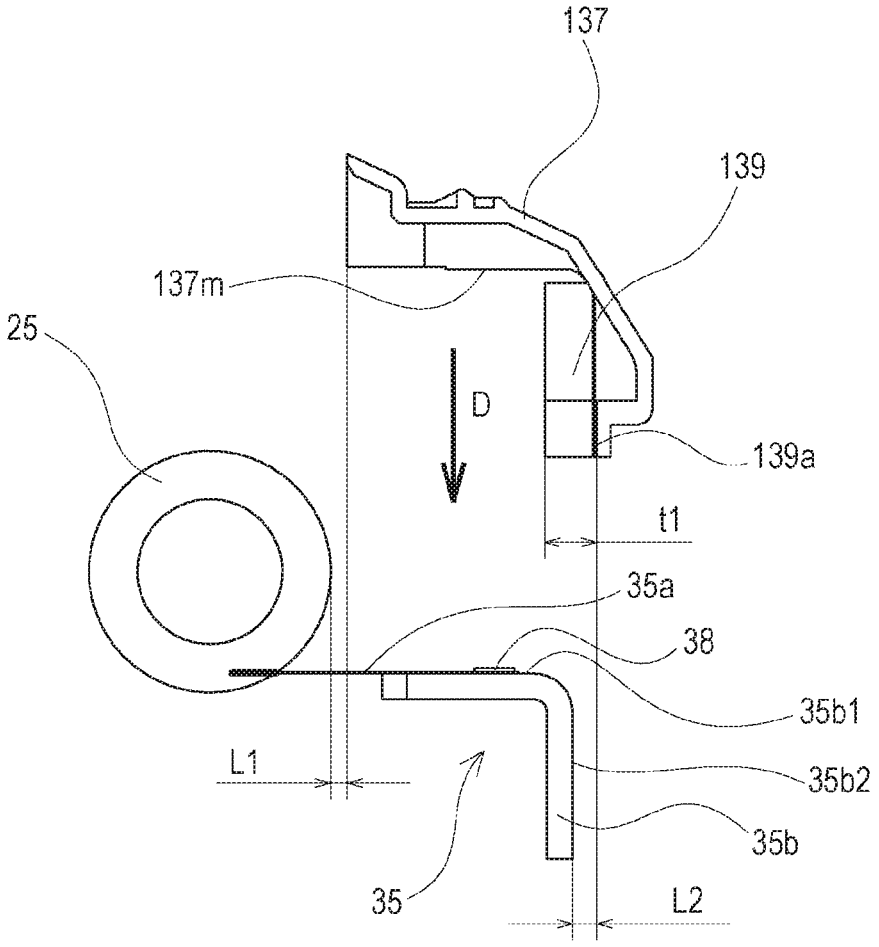
FIG. 16 is a cross-sectional view near the collecting member of the exemplary embodiment of the present disclosure.
Figure 17:
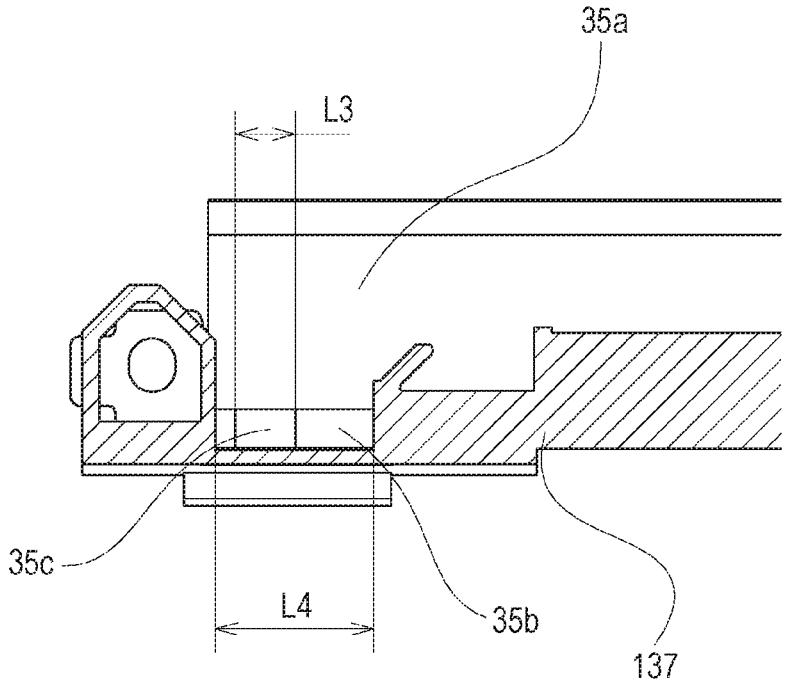
FIG. 17 is a cross-sectional view, viewed in a longitudinal direction, near the collecting member of the exemplary embodiment of the present disclosure.
Figure 18:
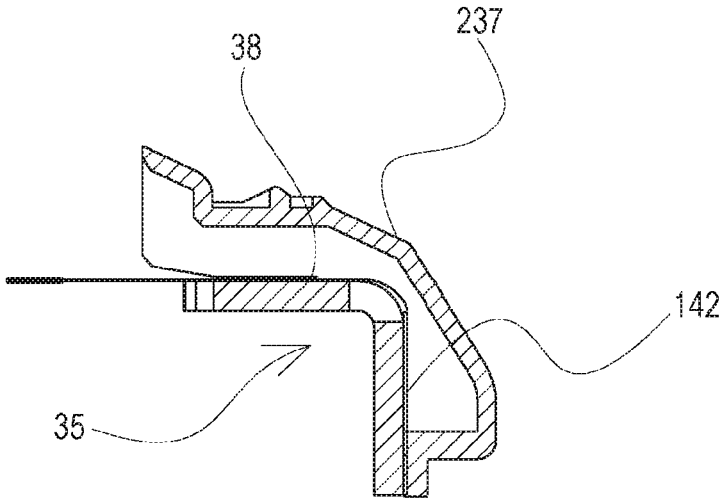
FIG. 18 is a cross-sectional view illustrating another mode of the collecting member according to the exemplary embodiment of the present disclosure.

FIG. 13A is a diagram illustrating a configuration of a development opening of the developing cartridge and illustrates a state before the development roller has been installed, and FIG. 13B illustrates a state in which the collecting member alone has been dismounted. FIG. 14 is a cross-sectional view near a collecting member 137 and illustrates a state in which a developing cartridge 94 is mounted in an apparatus main body. FIGS. 15A and 15B are perspective views illustrating a configuration of the collecting member 137 and an elastic sealing member 139 described later. FIG. 16 is a cross-sectional view illustrating a configuration fitting the collecting member 137 to the developing blade 35. FIG. 17 is a diagram illustrating a positional relationship between the developing blade 35 and the collecting member 137 in the longitudinal direction. FIG. 18 illustrates another configuration of the collecting member and is a cross-sectional view near the collecting member.

As illustrated in FIG. 13A, an end portion sealing member 81 is disposed in an end portion of the developing cartridge 94 in the longitudinal direction. Furthermore, a sheet member 82 and the developing blade 35 are disposed in the longitudinal direction thereof. Furthermore, as illustrated in FIG. 13B, the development roller 25 is provided in the developing frame 31 so as to oppose a development opening 90 (FIG. 13A) for supplying developer to the development roller 25.

Note that a regulating portion end 35*a*1 of the developing blade 35 and the end portion sealing member 81 overlap each other in the longitudinal direction of the development roller 25, the contact pressure of the regulating portion 35 against the development roller 25 becomes high at the regulating portion end 35*a*1. Accordingly, melt-adhesion of the developer easily occurs at the regulating portion end 35*a*1 with the above, and a slight gap may be created between the regulating portion 35 and the development roller 25 due to the melt-adhesion. Furthermore, while the developing cartridge 94 is driven, since the development roller 25 slides against the end portion sealing member 81, the particle of the developer may become coarse. When the coarse particles become pinched between the regulating portion 35*a* of the developing blade 35 and the development roller 25, similar to the above, a slight gap may be formed. Due to the above, the amount of toner leakage tends to be larger at the end portions of the developing blade 35 than that of the middle portion in the longitudinal direction of the developing blade 35.

The present exemplary embodiment proposes a configuration that increases the amount of developer collected at the end portions and the reduces scattering, compared with the mode described in the first exemplary embodiment. Note that since the configuration of the collecting member 137 at the longitudinal middle portion is similar to that of the first exemplary embodiment, description thereof is omitted.

As illustrated in FIG. 14, similar to the first exemplary embodiment, the collecting member 137 includes a first containing end portion 140*a*1 formed between the collecting member 137 and the regulating portion 35*a* (a first surface) of the developing blade 35. Furthermore, in the present exemplary embodiment, the collecting member includes a second containing end portion 140*a*2 formed with the support portion 35*b* of the developing blade 35. A detailed description of the collecting member 137 will be given below.

As illustrated in FIG. 15A, the collecting member 137 includes containing middle portion 140*b*, which contains the developer, at the longitudinal middle portion and first containing end portions 140*a*1, which contains the developer, at the longitudinal end portions. Furthermore, the collecting member 137 includes a second opposed surface 137*j* that opposes a bend portion 35*b*2 (a second surface) of the support portion 35*b* of the developing blade 35. The opposed surface 137*j* includes a recess 137*k*, and as illustrated in FIG. 15B, an elastic sealing member 139 having a U-shaped form is attached thereto with a two-sided adhesive tape 139*a* (FIG. 14). Furthermore, as illustrated in FIG. 16, the collecting member 137 is fixed to the developing blade 35 by adhering a fixing surface 137*m* to a two-sided adhesive tape 38 adhered to the regulating portion 35*a* of the developing blade 35. Note that the second containing end portion 140*a*2 is a space that is defined by the developing blade 35, the collecting member 137, and the elastic sealing member 139.

Referring next to FIG. 14, a configuration containing the developer will be described. As described above, included is the first containing end portion 140*a*1 formed between the developing blade 35 and the collecting member 137, and the second containing end portion 140*a*2 formed with the developing blade 35, the collecting ember 137, and the elastic sealing member 139. When the developing cartridge 94 is used, when there is a leakage of the developer due to the above described reason, the developer first moves along the regulating portion 35*a* and along an arrow P in the drawing, and falls in an arrow Q direction by its own weight and is collected in the second containing end portion 140*a*2. Furthermore, if not all of the developer is collected in the second containing end portion, the developer is sequentially collected by the first containing end portion 140*a*1. Furthermore, in order to collect the developer falling and scattering from the surface of the development roller 25 as much as possible, in the present exemplary embodiment, a collecting portion 137*c* that constitute an intaking opening 140*d* is formed to widely cover a portion under the development rollers 25. Furthermore, in a cross-sectional direction, a width L5 of the connection portion between the first containing end portion 140*a*1 and the second containing end portion 140*a*2 is smaller than a with between the first containing end portion 140*a*1 and the second containing end portion 140*a*2. The above provides a configuration in which the developer collected in the second containing end portion 140*a*2 does not easily reverse flow when the user handles the developing cartridge.

Note that a hole portion 35*c* is formed in the support portion 35*b* of the developing blade 35. The hole portion 35*c* is closed with a sealing tape 141 from a side opposite to the side to which the collecting member 137 is fitted. Moreover, as illustrated in FIG. 13B, the hole portion 35*c* is, in the longitudinal direction, positioned inside the end portion sealing member 81. In other words, the hole portion 35*c* is provided only at a portion described above near each end portion (an arrow C in FIG. 13B) of the developing blade 35 where the amount of developer leakage becomes large. As illustrated in FIG. 17, a width L3 of the hole portion 35*c* is smaller than a width L4 of the connection portion between the first containing end portion 140*a*1 and the second containing end portion 140*a*2. In other words, the developer fall easily into the second containing end portion 140*a*2 by passing through the hole portion 35*c* at the above portion.

Referring next to FIG. 16, a detail of a configuration fitting the collecting member 137 to the developing blade 35 will be described. In a state in which the elastic sealing member 139 is attached, the collecting member 137 is installed in an arrow D direction in the drawing. Furthermore, in order to collect a larger amount of the scattering developer, a gap L1 is set to a predetermined value so that the collecting member is close to the development roller 25 as possible. Accordingly, the gap L2 between the bend portion 35*b*2 of the developing blade 35 and the second opposed surface 137*j* of the collecting member 137 varies depending on the component tolerance or the error during assembling. A configuration illustrated in FIG. 18 that fixes and seals the collecting plate 237 and the developing blade 35 with two-sided adhesive tapes 38 and 142, for example, may be provided as another exemplary embodiment. In order to accurately configure the gap L1 between the collecting member 237 and the development roller 25, as in the present exemplary embodiment, a thickness U of the elastic sealing member 139 may be set wider than a gap obtained by taking the variation in the gap L2 in account; accordingly, the developer can be sealed effectively.

As described above, the capacity of the containing portion is increased by providing the containing portion of the developer provided at the end portions of the collecting member 137 in the longitudinal direction in the present exemplary embodiment to not only the opposing portion on the regulating portion 35*a* side of the developing blade 35 but also on the opposing portion side on the substantially orthogonal bend portion 35*b* side. Furthermore, since the containing portion is orthogonal in the cross-sectional direction, even when the user inclines the developing cartridge while in use, the developer does not easily leak out to the outside of the developing cartridge. Herein, in the present exemplary embodiment, while the first containing end portion 140*a*1 and the second containing end portion 140*a*2 are configured so as to be substantially orthogonal in the cross-sectional direction, the first containing end portion 140*a*1 and the second containing end portion 140*a*2 may be set at an angle that confirms with the shape of the support portion of the developing blade while obtaining similar effects.

In the present exemplary embodiment, the gap L2 between the support portion 35*b* of the developing blade 35 and the second opposed surface 137*j* of the collecting member 137 that configure the second containing end portion 140*a*2 is sealed with the elastic sealing member 139. With the above, when the collecting member 137 is installed on the developing blade 35, the gap L1 between the development roller 25 and the collecting member 137 can be adjusted regardless of the component tolerance and the like; accordingly, the developer that falls and scatters from the surface of the development roller 25 can be collected as much as possible.

In the present exemplary embodiment, the hole portion is provided in the support portion 35*b* corresponding to the developing blade end portion where the amount of leakage of the developer is larger than the middle portion in the longitudinal direction; accordingly, movement of the developer from the first containing end portion 140*a*1 to the second containing end portion 140*a*2 is facilitated. Furthermore, the width L5 of the connection portion between the first containing end portion 140*a*1 other than the hole portion 35*c* and the containing end portion 140*a*2 is smaller than those of the first containing end portions 140*a*1 and 140*a*2. With the above, similar to the above, even when the developing cartridge is inclined by the user handling the developing cartridge, the developer does not easily leak out from the containing portion. Note that in the present exemplary embodiment, the hole portion is provided in the support portion 35*b* of the developing blade 35; however, the hole portion may be provided on the collecting member 137 side or the hole portion does not necessarily need to be provided.

Note that while the collecting member 137 and the developing blade 35 are fixed with a two-sided adhesive tape, similar to the first exemplary embodiment, adhesion may be performed with an adhesive agent or a hot melt. Furthermore, without having an adhesive member interposed in between, the collecting member 137 and the developing blade 35 may be in direct contact with each other by being in pressure contact with a screw or the like.

Furthermore, in the present exemplary embodiment, while the elastic sealing member 139 is fixed to the collecting member 137 with a two-sided adhesive tape, the elastic sealing member 139 may be adhered with an adhesive agent or the like, or may be fixed on the support portion side of the developing blade 35. Alternatively, a configuration in which the elastic sealing member is press-fitted into the gap L2 can provide a similar effect. As described above, the exemplary embodiments described above can be modified in various ways within the scope of the present disclosure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-167765 filed Aug. 31, 2017 and Japanese Patent Application No. 2018-024402 filed Feb. 14, 2018, which are hereby incorporated by reference herein in their entirety.

What is claimed is:

1. A cartridge detachably attachable to an apparatus main body of an image forming apparatus, the cartridge comprising:

a developer bearing member configured to bear developer on a surface thereof;

a frame that supports the developer bearing member so that the developer bearing member is rotatable;

a developing blade including a regulating member that regulates a thickness of a layer of the developer borne on the surface of the developer bearing member, and a support member that is fixed to the frame and that supports the regulating member; and an accommodating member supported by the support member and configured to form an accommodating portion for accommodating the developer scattered from the developer bearing member therein, wherein the accommodating member is configured to form an opening through which the developer enters into the accommodating portion and which opposes the developer bearing member, and a bottom of accommodating portion that is the farthest part of the accommodating portion from the opening in a state the accommodating member is supported by the support member, wherein the accommodating portion of the accommodating member includes a longitudinal end region corresponding to a longitudinal end portion of the developer bearing member and a longitudinal middle region corresponding to a longitudinal middle portion of the developer bearing member, and wherein the bottom of the accommodating portion at the longitudinal end region is farther away from the developer bearing member than that at the longitudinal middle region in a direction orthogonal to a rotational axis direction of the developer bearing member, and wherein, a sectional area of the accommodating portion, orthogonal to the rotational axis direction, at the longitudinal end region is larger than that at the longitudinal middle region.

2. The cartridge according to claim 1, wherein in the accommodating member includes a partitioning portion that partitions the accommodating portion into the longitudinal end region and the longitudinal middle region.

3. The cartridge according to claim 1, wherein the accommodating portion is a space surrounded by the accommodating member and a surface of the support member extending toward the developer bearing member.

4. The cartridge according to claim 3, wherein on a cross section in a direction perpendicular to the rotational axis direction, an end portion of the accommodating member on a side of the developer bearing member becomes farther away from the surface of the support member in a direction crossing a direction in which the surface of the supporting member extends as the end portion of the accommodating member approaches the developer bearing member.

5. The cartridge according to claim 1, wherein in the longitudinal end region, the accommodating member includes a regulating portion that regulate moving of the developer in a direction from the longitudinal end region toward the longitudinal middle region of the accommodating portion, the regulating portion being inclined so as to approach the developer bearing member as the regulating portion goes in a direction from the longitudinal middle region of the accommodating portion.

6. The cartridge according to claim 1, wherein the cartridge does not include a photosensitive drum.

7. The cartridge according to claim 1, wherein in a case where the cartridge is attached to the apparatus main body having a photosensitive drum and an exposure device configured to expose the photosensitive drum, the developer bearing member is arranged above the exposure device, and the opening is arranged under the developer bearing member.

8. A cartridge detachably attachable to an apparatus main body of an image forming apparatus, the cartridge comprising:

a developer bearing member configured to bear developer on a surface thereof;

a frame that supports the developer bearing member so that the developer bearing member is rotatable;

a developing blade including a regulating member that regulates a thickness of a layer of the developer borne on the surface of the developer bearing member, and a support member that is fixed to the frame and that supports the regulating member; and an accommodating member supported by the support member and configured to form an accommodating portion for accommodating the developer scattered from the developer bearing member therein wherein the accommodating member is configured to form an opening through which the developer enters into the accommodating portion and which opposes the developer bearing member when the accommodating member is supported by the support member, and wherein the accommodating portion of the accommodating member includes a longitudinal end region corresponding to a longitudinal end portion of the developer bearing member and a longitudinal middle region corresponding to a longitudinal middle portion of the developer bearing member, and a width of the opening, which is perpendicular to the rotational axis direction, at the longitudinal end region of the accommodating portion is larger than that at the longitudinal middle region of the accommodating portion.

9. The cartridge according to claim 8, wherein the accommodating member includes a partitioning portion that partitions the accommodating portion into the longitudinal end region and the longitudinal middle region.

10. The cartridge according to claim 8, wherein the accommodating portion is a space surrounded by the accommodating member and a surface of the support member extending toward the developer bearing member.

11. The cartridge according to claim 10, wherein on a cross section of the cartridge orthogonal to the rotational axis direction, an end portion of the accommodating member on a side of the developer bearing member becomes farther away from the surface of the support member in a direction crossing a direction in which the surface of the supporting member extends as the end portion of the accommodating member approaches the developer bearing member.

12. The cartridge according to claim 8, wherein in the longitudinal end region of the accommodating portion, the accommodating member includes a regulating portion that regulates moving of the developer in a direction from the longitudinal end region toward the longitudinal middle region inside the longitudinal end region of the accommodating portion, and wherein the regulating portion is inclined so as to approach the developer bearing member as the regulating portion goes in a direction from the longitudinal end region toward the longitudinal middle region of the accommodating portion.

13. The cartridge according to claim 8, wherein the cartridge does not include a photosensitive drum.

14. The cartridge according to claim 8, wherein in a case where the cartridge is attached to the apparatus main body having a photosensitive drum and an exposure device configured to expose the photosensitive drum, the developer bearing member is arranged above the exposure device, and the opening is arranged under the developer bearing member.

15. A cartridge detachably attachable to an apparatus main body of an image forming apparatus, the cartridge comprising:

a developer bearing member configured to bear developer on a surface thereof;

a frame that supports the developer bearing member so that the developer bearing member is rotatable;

a developing blade including a regulating member that regulates a thickness of a layer of the developer borne on the surface of the developer bearing member; and a support member that is fixed to the frame and that supports the regulating member; and an accommodating member supported by the support member and configured to form an accommodating portion for accommodating the developer scattered from the developer bearing member therein, wherein the accommodating member is configured to form an opening through which the developer enters into the accommodating portion and which opposes the developer bearing member in a state that the accommodating member is supported by the support member, wherein the accommodating portion of the accommodating member includes a longitudinal end region corresponding to a longitudinal end portion of the developer bearing member and a longitudinal middle region corresponding to a longitudinal middle portion of the developer bearing member, and wherein the accommodating member includes a partitioning portion that partitions the accommodating portion into the longitudinal end region and the longitudinal middle region.

16. The cartridge according to claim 15, wherein the accommodating portion is a space surrounded by the accommodating member and a surface of the support member extending toward the developer bearing member.

17. The cartridge according to claim 15, wherein on a cross section of the cartridge orthogonal to the rotational axis direction, an end portion of the accommodating member on a side of the developer bearing member becomes farther away from the surface of the support member in a direction crossing a direction in which the surface of the supporting member extends as the end portion of the accommodating member approaches the developer bearing member.

18. The cartridge according to claim 15, wherein in the longitudinal end region, the accommodating member includes a regulating portion that regulates moving of the developer in a direction from the longitudinal end region toward the longitudinal middle region inside the longitudinal end region, the regulating portion being inclined so as to approach the developer bearing member as the regulating portion goes in a direction from the longitudinal end region toward the longitudinal middle region of the accommodating portion.

19. The cartridge according to claim 15, wherein in a case where the cartridge is attached to the apparatus main body having a photosensitive drum and an exposure device configured to expose the photosensitive drum, the developer bearing member is arranged above the exposure device, and the opening is arranged under the developer bearing member.

20. A cartridge detachably attachable to an apparatus main body of an image forming apparatus, the cartridge comprising:

a developer bearing member configured to bear developer on a surface thereof;

a frame that supports the developer bearing member so that the developer bearing member is rotatable;

a developing blade including a regulating member that regulates a thickness of a layer of the developer borne on the surface of the developer bearing member, and a support member that is fixed to the frame and that supports the regulating member, the support member including a first surface extending in a first direction toward the developer bearing member and supports the regulating member and a second surface extending in a second direction crossing the first direction and arranged farther away from the developer bearing member than the first surface on a cross section of the cartridge orthogonal to a rotational axis direction of the developer bearing member; and an accommodating member configured to form first and second accommodating portions for accommodating the developer scattered from the developer bearing member therein, wherein the first and second accommodating portions are arranged so as to overlap with a longitudinal end portion of the developer bearing member in the rotational axis direction when viewed in a direction crossing the rotational axis direction and are communicated with each other, and wherein the accommodating member is supported by the support member so that the first and second accommodating portions are arranged so as to oppose the first and second surfaces, respectively, and is configured to form an opening through which the developer enters into the first and the second accommodating portions and which opposes the developer bearing member in a state the accommodating member is supported by the support member.

21. The cartridge according to claim 20, further comprising: an end seal sealing a gap between the longitudinal end portion of the developer bearing member and the frame, wherein the first and second accommodating portions are arranged so as to overlap with the end seal in the rotational axis direction when viewed in the direction crossing the rotational axis direction.

22. The cartridge according to claim 21, wherein a longitudinal end of the regulating member is sandwiched between the end seal and the longitudinal end portion of the developer bearing member.

23. The cartridge according to claim 20 further comprising: an elastic seal sealing a gap between the second surface of the support member and the accommodating member, wherein the first accommodating portion is a space surrounded by the first surface of the support member and the accommodating member, and the second accommodating portion is a space surrounded by the second surface of the support member, the accommodating member, and the elastic seal.

24. The cartridge according to claim 20, wherein the support member has a corner surface between the first surface and the second surface of the support member, and the accommodating member is configured to form a third accommodating portion opposing the corner surface of the support member in a state that the accommodating member is supported by the support member, and wherein on the cross section of the cartridge, a width of the third accommodating portion is smaller than either of a width of the first accommodating portion and a width of the second accommodating portion.

25. The cartridge according to claim 20, wherein in a case where the cartridge is attached to the apparatus main body having a photosensitive drum and an exposure device configured to expose the photosensitive drum, the developer bearing member is arranged above the exposure device, and the opening is arranged under the developer bearing member.

* * * * *